US006887338B1

(12) United States Patent
Taylor

(10) Patent No.: US 6,887,338 B1
(45) Date of Patent: May 3, 2005

(54) 300 MM PLATEN AND BELT CONFIGURATION

(75) Inventor: Travis Robert Taylor, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 218 days.

(21) Appl. No.: 10/186,930

(22) Filed: Jun. 28, 2002

(51) Int. Cl.[7] ..... C23F 1/00; H05H 1/00
(52) U.S. Cl. ..... 156/345.12; 156/345.2
(58) Field of Search ..... 156/345.12, 345.2; 451/66, 81, 273

(56) References Cited

U.S. PATENT DOCUMENTS 6,328,642 B1 * 12/2001 Pant et al. ..... 451/307
6,336,845 B1 * 1/2002 Engdahl et al. ..... 451/41
6,712,679 B2 * 3/2004 Taylor et al. ..... 451/303
6,722,946 B2 * 4/2004 Talieh et al. ..... 451/8
6,729,945 B2 5/2004 Xu et al.
6,790,128 B1 9/2004 Taylor et al.
2002/0151256 A1 10/2002 Taylor et al.

* cited by examiner

*Primary Examiner*—Parviz Hassanzadeh
(74) *Attorney, Agent, or Firm*—Martine, Penilla & Gencarella, LLP

(57) ABSTRACT

An invention is provided for a chemical mechanical planarization apparatus for processing 300 millimeter wafers. The CMP apparatus includes a polishing belt having a belt tension in a range of about 3000 lbs to 4000 lbs. In addition, a platen is disposed below the polishing belt at a positive platen height. The platen includes at least three air pressure zones, with each air pressure zone being capable of providing air pressure to a backside of the polishing belt. The platen can include, for example, eight air pressure zones. In this aspect, a second air pressure zone adjacent to a first outermost air pressure zone provides an air pressure in a range of about 30 psi to 50 psi, such as about 34 psi. In addition, a third air pressure zone a fourth pressure zone can each provide an air pressure in a range of about 4 psi to 13 psi, such as about 7 psi. In this aspect, the remaining air pressure zones can be set to 0 psi, which conserves fluid consumption. Additional fluid consumption reduction can be achieved using a plurality of check values disposed within an air supply system coupled to the platen, wherein the check values prevent negative airflow into the platen.

15 Claims, 10 Drawing Sheets

300 MM PLATEN AND BELT CONFIGURATION

BACKGROUND OF THE INVENTION

1. Field of the Invention

This invention relates generally to chemical mechanical planarization apparatuses, and more particularly to methods and apparatuses for improved uniformity in chemical mechanical planarization applications using increased belt tension, platen pressure zones, and positive platen height.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system is typically utilized to polish a wafer as described above. A CMP system typically includes system components for handling and polishing the surface of a wafer. Such components can be, for example, a rotary polishing pad, an orbital polishing pad, or a linear belt polishing pad. The pad itself is typically made of a polyurethane material or polyurethane in conjunction with other materials such as, for example, a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface is substantially planarized. The wafer may then be cleaned in a wafer cleaning system.

FIG. 1A shows a linear polishing apparatus 10 typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12, which moves linearly with respect to the surface of the wafer 16. The belt 12 is a continuous belt. A motor typically drives the rollers so that the rotational motion of the rollers 20 causes the polishing belt 12 to be driven in a linear motion 22 with respect to the wafer 16.

A wafer carrier 18 holds the wafer 16. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12 while applying pressure to the polishing belt. The polishing belt 12 is a continuous belt typically made up of a polymer material such as, for example, the IC 1000 made by Rodel, Inc. layered upon a supporting layer. The rollers 20 rotate, moving the polishing belt in the linear motion 22 with respect to the wafer 16. In one example, a fluid bearing platen 24 supports a section of the polishing belt under the region where the wafer 16 is applied. The platen 24 can then be used to apply fluid against the under surface of the supporting layer of the belt pad. The applied fluid thus forms a fluid bearing that creates a polishing pressure on the underside of the polishing belt 12 that is applied against the surface of the wafer 16.

Edge instabilities in CMP are among the most significant performance affecting issues and among the most complicated problems to resolve. FIG. 1C shows a linear polishing apparatus 10 illustrating edge effect non-uniformity factors. In this example, a wafer 16 is attached to a carrier 18, which applies pressure 13 to push the wafer 16 down on the polishing belt 12 that is moving linearly over the platen 24. However, the polishing belt 12 deforms when the wafer contacts the polishing belt 12. Although the polishing bell 12 is a compressible medium, the polishing belt 12 has limited flexibility, which prevents the polishing belt 12 from conforming to the exact shape of the wafer 16, forming transient deformation zones 22 and 26. As a result, edge effects occur at the wafer edge from a non-flat contact field resulting from redistributed contact forces. Hence, large variations in removal rates occur at the wafer edge, resulting in reduced wafer yield.

In view of the foregoing, there is a need for an apparatus that overcomes the problem of wafer edge effect. The apparatus should promote uniformity by reducing edge effect, without requiring undue changes to current CMP operations.

SUMMARY OF THE INVENTION

Broadly speaking, the present invention fills these needs by providing a 300 millimeter (mm) CMP platen and Belt configuration that greatly reduces edge effect. In one embodiment a CMP apparatus for processing 300 millimeter wafers is disclosed. The CMP apparatus includes a polishing belt having a belt tension in a range of about 3000 lbs to 4000 lbs. In addition, a platen is disposed below the polishing belt at a positive platen height. The platen includes at least three air pressure zones, with each air pressure zone being capable of providing air pressure to a backside of the polishing belt. In one aspect, the platen can be positioned at a platen height in a range of about 25 mil–65 mil, such as at about 48 mil. The platen can include, for example, eight air pressure zones. In this aspect, a second air pressure zone adjacent to a first outermost air pressure zone provides an air pressure in a range of about 30 psi to 50 psi, such as about 34 psi. In addition, a third air pressure zone adjacent to the second air pressure zone and a fourth pressure zone adjacent to the third air pressure zone can each provide an air pressure in a range of about 4 psi to 13 psi, such as about 7 psi. In this aspect, the remaining air pressure zones can be set to 0 psi, which conserves fluid consumption. Additional fluid consumption reduction can be achieved using a plurality of check values disposed within an air supply system coupled to the platen, wherein the check values prevent airflow into the platen.

A method for performing a CMP process is disclosed in a further embodiment. The method includes configuring a polishing belt to have a bell tension in a range of about 3000 lbs to 4000 lbs. In addition, a platen is set to have a positive platen height. As above, the platen has at least three air pressure zones, and each air pressure zone is capable of providing air pressure to a backside of the polishing belt. In this manner, an undesirable wafer edge effect can be avoided when a wafer is applied to the polishing belt using a predefined downforce pressure. As above, the platen can include eight air pressure zones, wherein a second air pressure zone adjacent to a first outermost air pressure zone is configured to provide an air pressure in a range of about 30 psi to 50 psi. In addition, a third air pressure zone adjacent to the second air pressure zone and a fourth pressure zone adjacent to the third air pressure zone can each be configured to provide an air pressure in a range of about 4 psi to 13 psi. Further, as above, the remaining air pressure zones can be configured to 0 psi to conserve fluid consumption.

An additional CMP apparatus for processing 300 millimeter wafers is disclosed in an additional embodiment of the present invention. As above, the CMP apparatus includes a polishing belt having a belt tension in a range of about 3000 lbs to 4000 lbs, and a platen disposed below the polishing belt at a positive platen height. However, in this embodiment, the platen has only three independently controlled air pressure zones, each of which is capable of providing air pressure to a backside of the polishing belt. In addition, the first outermost air pressure zone primarily provides an air bearing for the polishing belt. The second and third air pressure zones primarily control tuning of a removal rate profile. The platen can be positioned, for example, at a platen height in a range of about 25 mil–65 mil. Similar to above, the first air pressure zone can provide an air pressure in a range of about 30 psi to 50 psi, and the second and the third air pressure zones can each provide an air pressure in a range of about 4 psi to 13 psi. For example, the first air pressure zone can provide an air pressure of 34 psi, and the second and the third air pressure zones can each provide an air pressure of 7 psi.

Using the embodiments of the present invention, wafer edge effect can be greatly reduced. Further, embodiments of the present invention advantageously reduce fluid consumption by using only three air pressure zones to provide a positive (out of the platen) airflow, and by using check values to prevent negative (into the platen) airflow. Thus, the embodiments of the present invention improve within wafer nonuniformity. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a 300 millimeter (mm) CMP platen and Belt configuration that greatly reduces edge effect. Broadly speaking, embodiments of the present invention increase belt tension during CMP processing. As a result, platen height and air bearing adjustments can have a greater affect on reducing fast removal rates at the edge of the wafer. In this manner, the embodiments of the present invention improve within wafer nonuniformity. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1A:
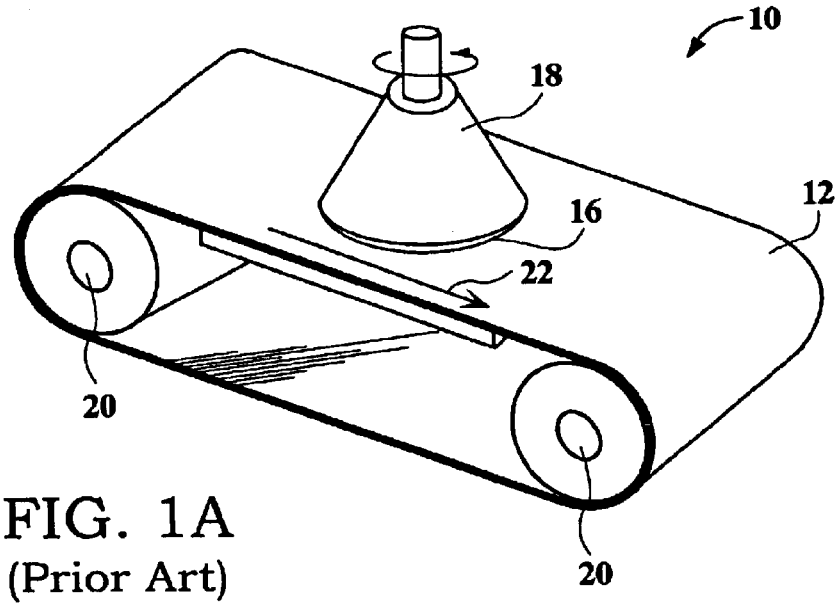
FIG. 1A (Prior Art)
FIG. 1A shows a linear polishing apparatus typically utilized in a CMP system.
Figure 1B:
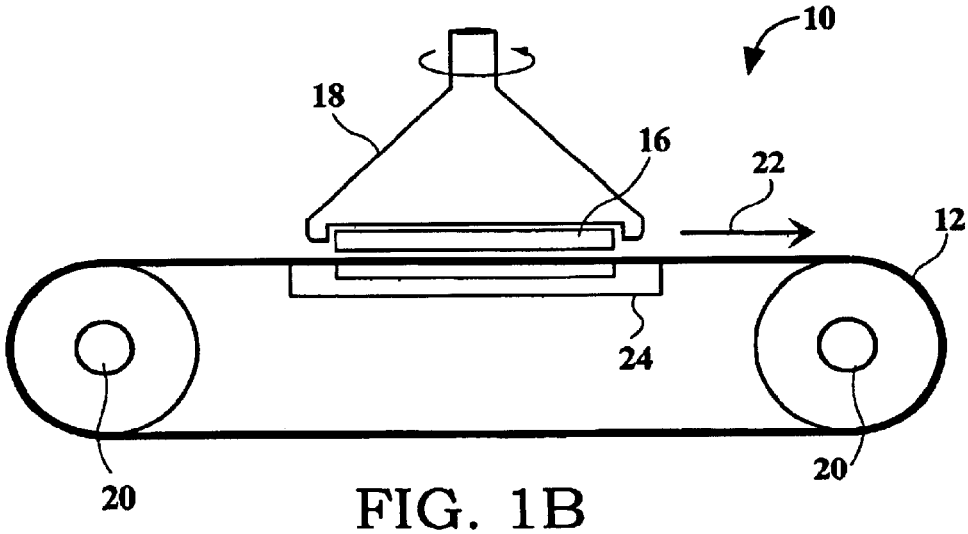
FIG. 1B (Prior Art)
FIG. 1B shows a side view of the linear polishing apparatus.
Figure 1C:
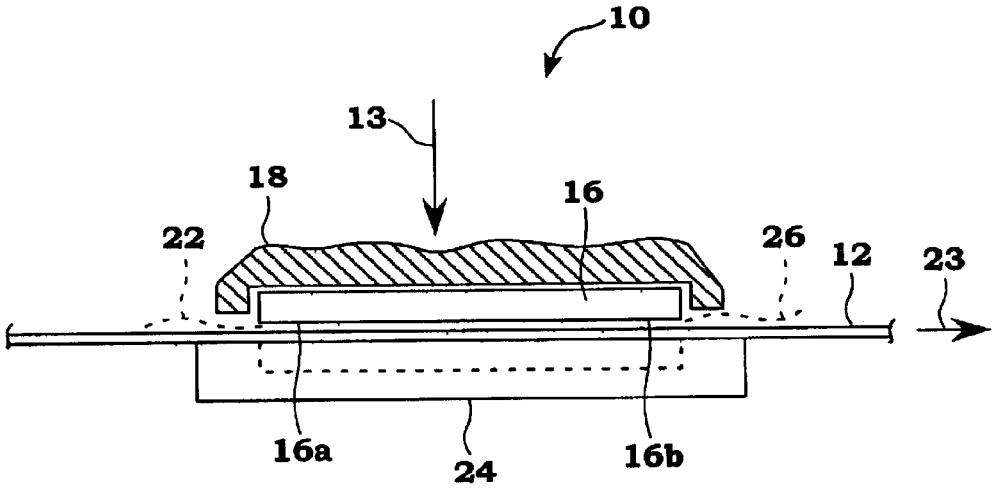
FIG. 1C (Prior Art)
FIG. 1C shows a linear polishing apparatus illustrating edge effect non-uniformity factors.
Figure 2:
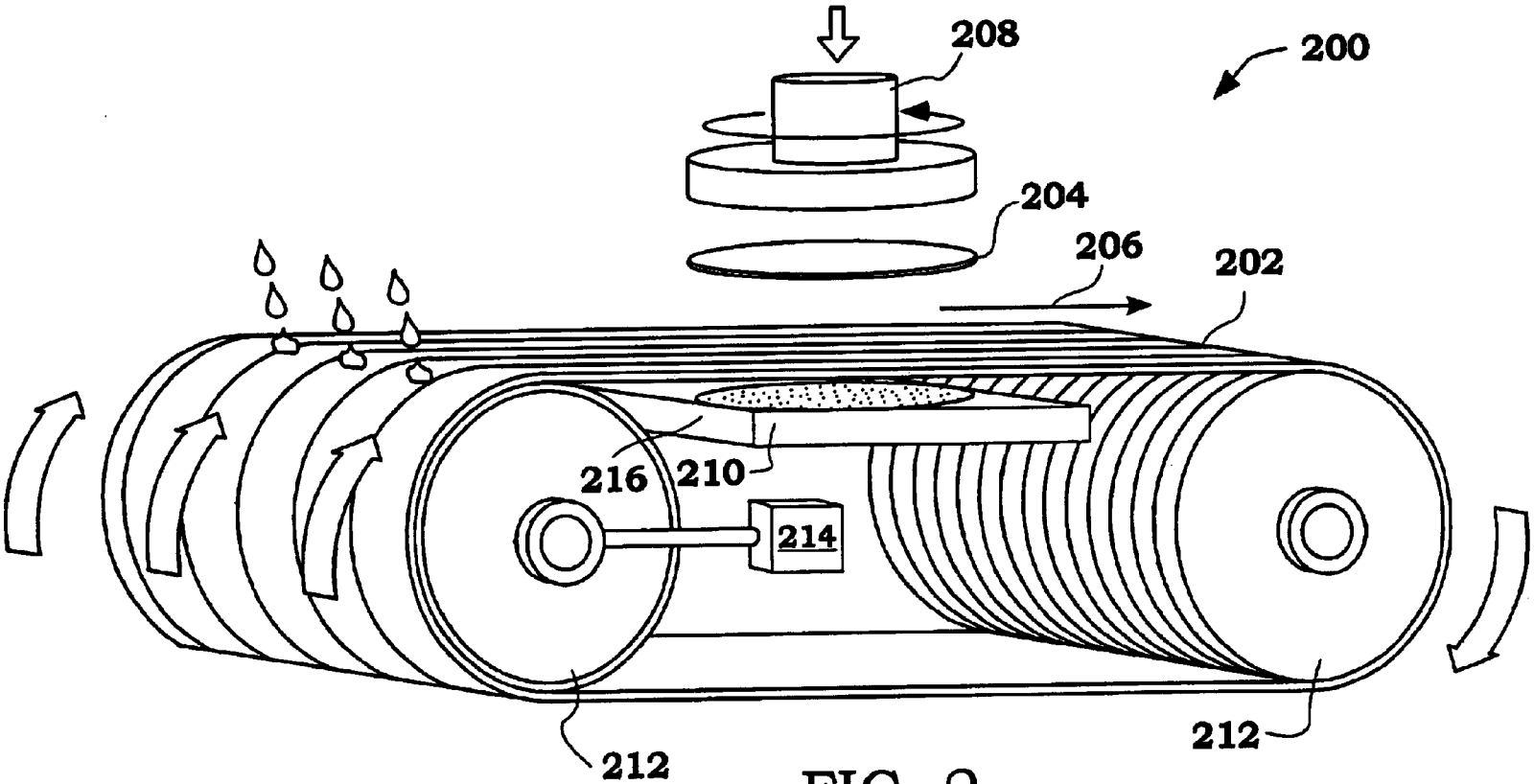
FIG. 2 shows a side view of a linear wafer polishing apparatus optimized for reduced edge effect, in accordance with an embodiment of the present invention.

FIG. 2 shows a side view of a linear wafer polishing apparatus 200 optimized for reduced edge effect, in accordance with an embodiment of the present invention. The linear wafer polishing apparatus 200 includes a carrier head 208, which secures and holds a wafer 204 in place during processing. In addition, a polishing belt 202 forms a continuous loop around rotating drums 212, and generally moves in a direction 206 at a speed of about 400 feet per minute, however this speed may vary depending upon the specific CMP operation. Belt tension is controlled using a pair of pistons 214, which exert force on one of the drums 212 to manipulate the tension in the polishing belt 202. As the polishing belt 202 moves during the CMP process, the carrier head 208 rotates and lowers the wafer 204 onto the top surface of the polishing belt 202, thus loading it with required polishing pressure.

A fluid bearing platen manifold assembly 210 supports the polishing belt 202 during the polishing process. Supporting the platen manifold assembly 210 is platen surround plate 216, which holds the platen manifold assembly 210 in place. To provide a fluid bearing for the polishing belt 202 during CMP operations, gas pressure is inputted through the platen manifold assembly 210 from a gas source. As will be described in greater detail subsequently, a plurality of independently controlled output holes provides upward force on the polishing belt 202 to control the polishing pad profile.

As mentioned above, the removal rate uniformity is an issue for all locations on the wafer 204, however, it is particularly difficult near the wafer edge. Hence, one key to optimal within wafer nonuniformity is to diminish or eliminate the fast edge. Embodiments of the present invention address this issue by changing the conventional process parameters and CMP system characteristics to promote uniformity. In particular, embodiments of the present invention increase belt tension in the linear CMP apparatus 200 to achieve optimal platen process performance.

As mentioned above, belt tension is controlled using a pair of pistons 214, which exert force on one of the drums 212 to manipulate the tension in the polishing belt 202. Prior art linear wafer polishing apparatuses for 300 mm wafers generally exert about 1600 lbs on the drums. Embodiments of the present invention increase the force exerted on the drums 212 to a force in the range of about 3000 lbs to about 4000 lbs, using the pair of pistons 214. As a result, the belt tension for the CMP apparatus 200 is dramatically increased.

It should be noted, however, that embodiments of the present invention are not limited to the use of pistons 214 to exert force on the drums. That is, any source of force can be utilized to exert force on the drums and thus control belt tension, such as lever and pulley based force sources, chain based force sources, and other sources of force that will be apparent to those skilled in the art after a careful reading of the present disclosure.

Figure 3:
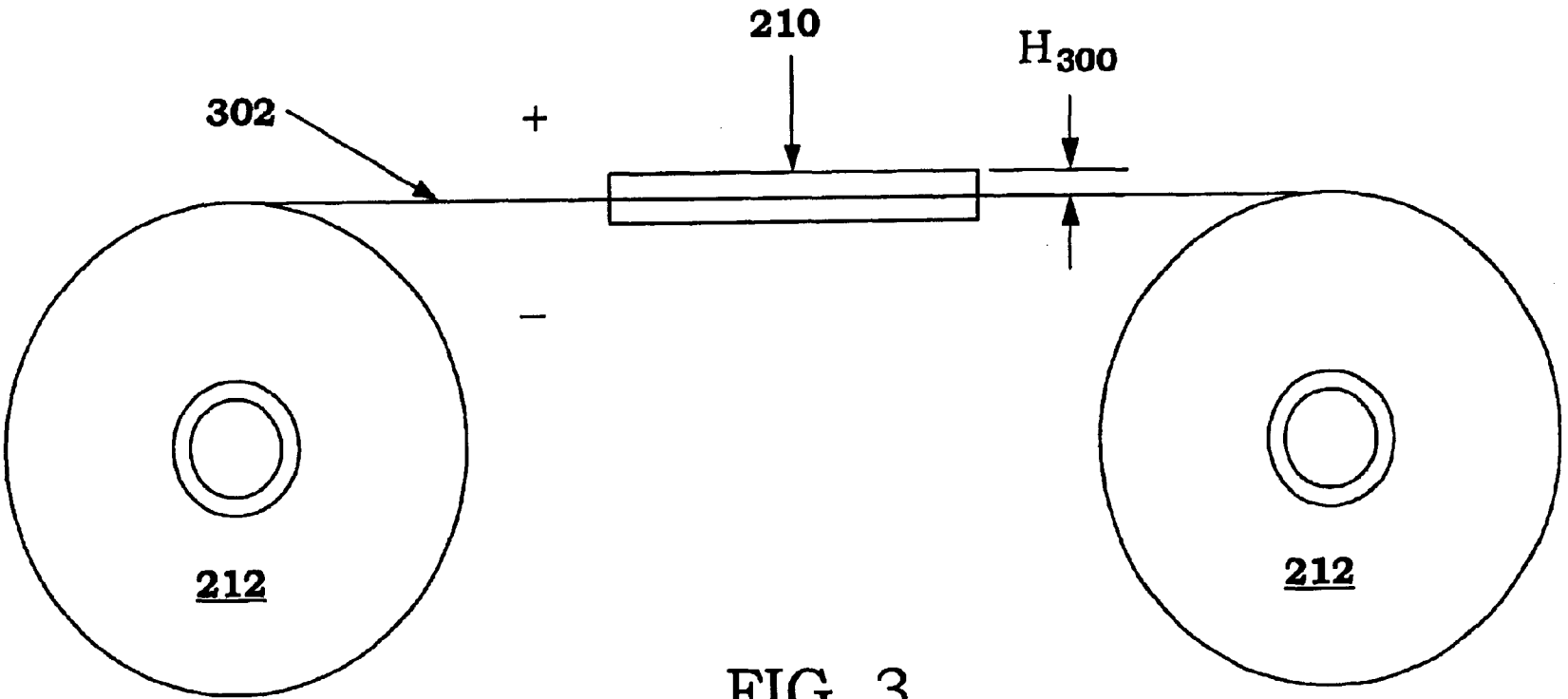
FIG. 3 is an illustration showing platen height relationships in a linear wafer polishing apparatus, in accordance with an embodiment of the present invention.

As will be described in greater detail subsequently, the increased belt tension allows the removal rate profile to be greatly affected, and thus optimally tuned, using platen height and air pressure zones. Platen height refers to the position of the top surface of the platen manifold assembly 210 with respect to the top of the drums 212. FIG. 3 is an illustration showing platen height relationships in a linear wafer polishing apparatus, in accordance with an embodiment of the present invention. In the present description, drum height 302 refers to the height of the plane defined by the top of drums 212, as illustrated in FIG. 3. Hence, platen height describes the position of the top surface of the platen manifold assembly 210 with respect to the drum height 302.

A positive platen height occurs when the top surface of the platen manifold assembly 210 is above the drum height 302. Conversely, a negative platen height occurs when the top surface of the platen manifold assembly 210 is below the drum height 302. A platen height of zero occurs when the top surface of the platen manifold assembly 210 coincides with the drum height 302.

Embodiments of the present invention utilize a positive platen height, in conjunction with the increased belt tension, to reduce edge effect during wafer planarization. In one embodiment, the platen height $H_{300}$ is in the range of about 25 mil to 65 mil. For example, in FIG. 3, the platen height $H_{300}$ is 48 mil. In this manner, the positive platen height causes a mechanical deformation of the polishing belt 202, which allows the air pressure zones of the platen manifold assembly 210 to greatly affect the planarization process.

Figure 4:
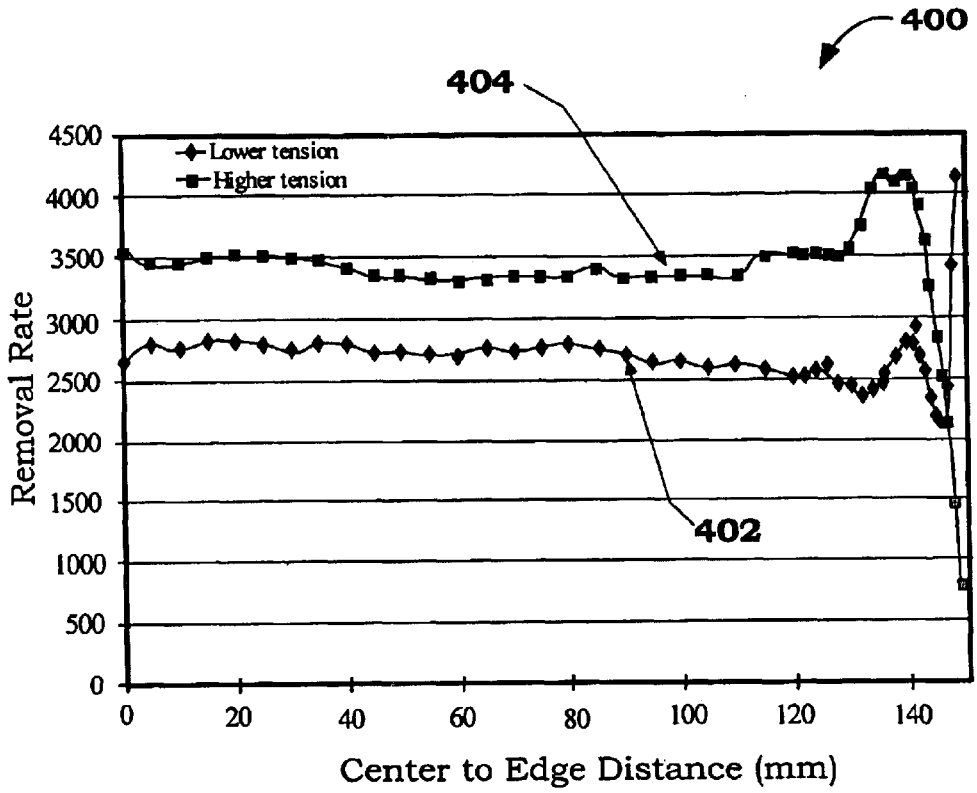
FIG. 4 is a graph comparing removal rate profiles generated using varying belt tensions, in accordance with an embodiment of the present invention.

For example, FIG. 4 is a graph 400 comparing removal rate profiles generated using varying belt tensions, in accordance with an embodiment of the present invention. In particular, the graph 400 shows a removal rate profile 402 using a low belt tension of about 1600 lbs. In addition, a removal rate profile 404 is shown in graph 400 using a high belt tension of about 4000 lbs. As can be seen from profile 402, the removal rate greatly increases at the edge of the wafer, from about 140–150 mm radius, when using a low belt tension. However, as shown by profile 404, the removal rate at the edge of the wafer can be made to decrease when using a high tension belt, for example, in the range of about 3000 lbs to 4000 lbs. Thus, when the belt tension is increased to about 3000 lbs to 4000 lbs, a positive platen height allows air pressure zones of the platen manifold assembly 210 to fine tune the planarization process, as described in greater detail subsequently.

Figure 5A:
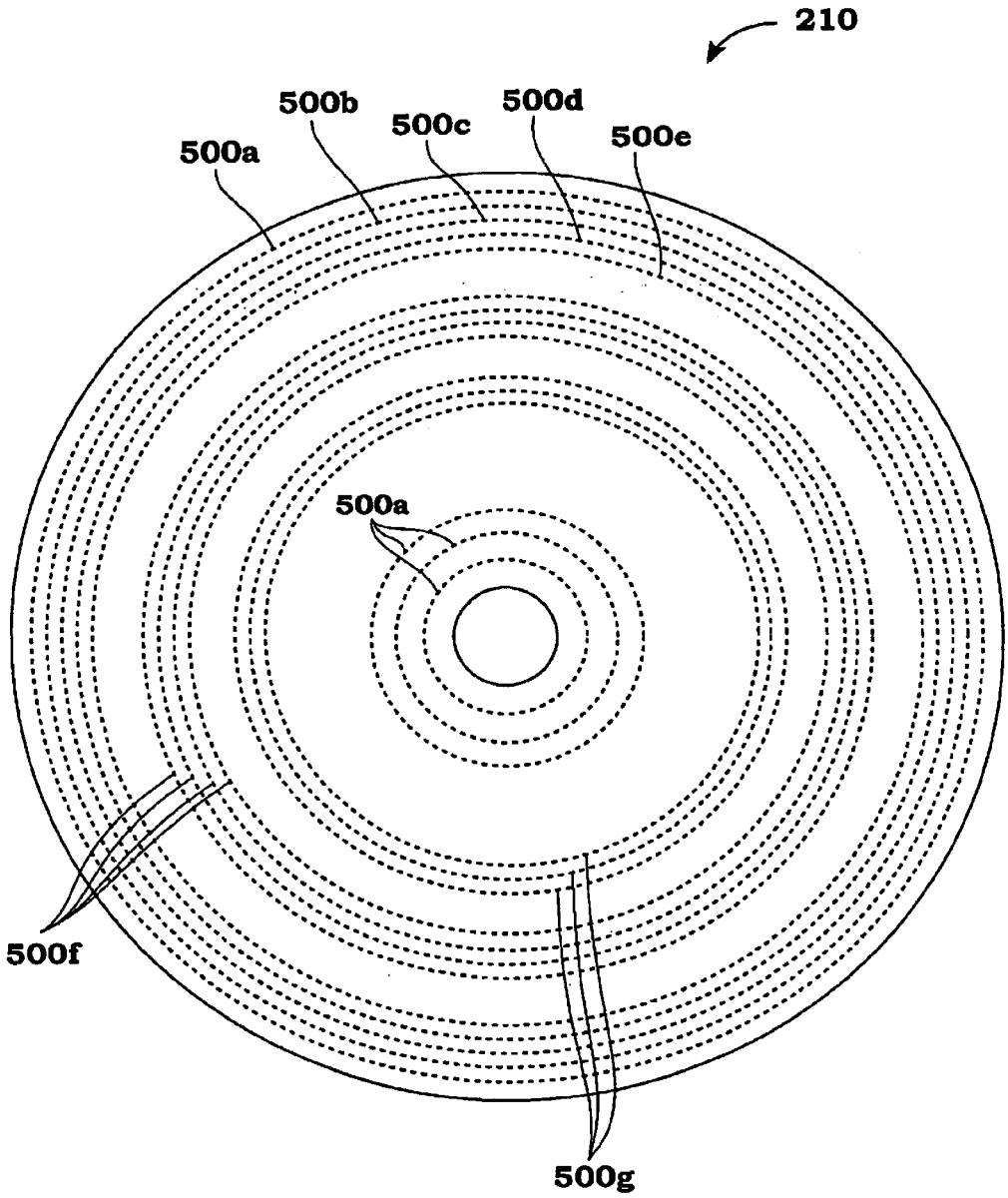
FIG. 5A is a top view of the platen manifold assembly used to provide an air bearing during CMP operations, in accordance with an embodiment of the present invention.

FIG. 5A is a top view of the platen manifold assembly 210 used to provide an air bearing during CMP operations, in accordance with an embodiment of the present invention. The platen manifold assembly 210 includes a plurality of independently controlled air pressure zones 500*a*–500*h* utilized to provide air pressure to the back of the polishing belt during CMP operations. Each air pressure zone 500*a*–500*h* comprises one or more concentric rings of air holes, which are used to provide air to the backside of the polishing belt. The air pressure provides an air bearing for the polishing belt to "ride" on during planarization. The air bearing also provides resistance to the downforce from the carrier head to allow polishing of the wafer surface. The independently controlled air pressure zones 500*a*–500*h* allow fine tuning of the removal rate profile during the planarization process.

In particular, eight air pressure zones are included in the platen manifold assembly 210 illustrated in FIG. 5A. Air pressure zone 1 500*a* is located outside the edge of the wafer, and air pressure zones 2–5 500*b*–500*e* are located near the edge of the wafer. Air pressure zone 6 500*f* comprises four concentric rings of air holes, and air pressure zone 7 500*g* comprises three concentric rings of air holes. Finally, air pressure zone 8 500*h* comprises three concentric rings of air holes located nearest to the center of the wafer during the CMP process.

Figure 6:
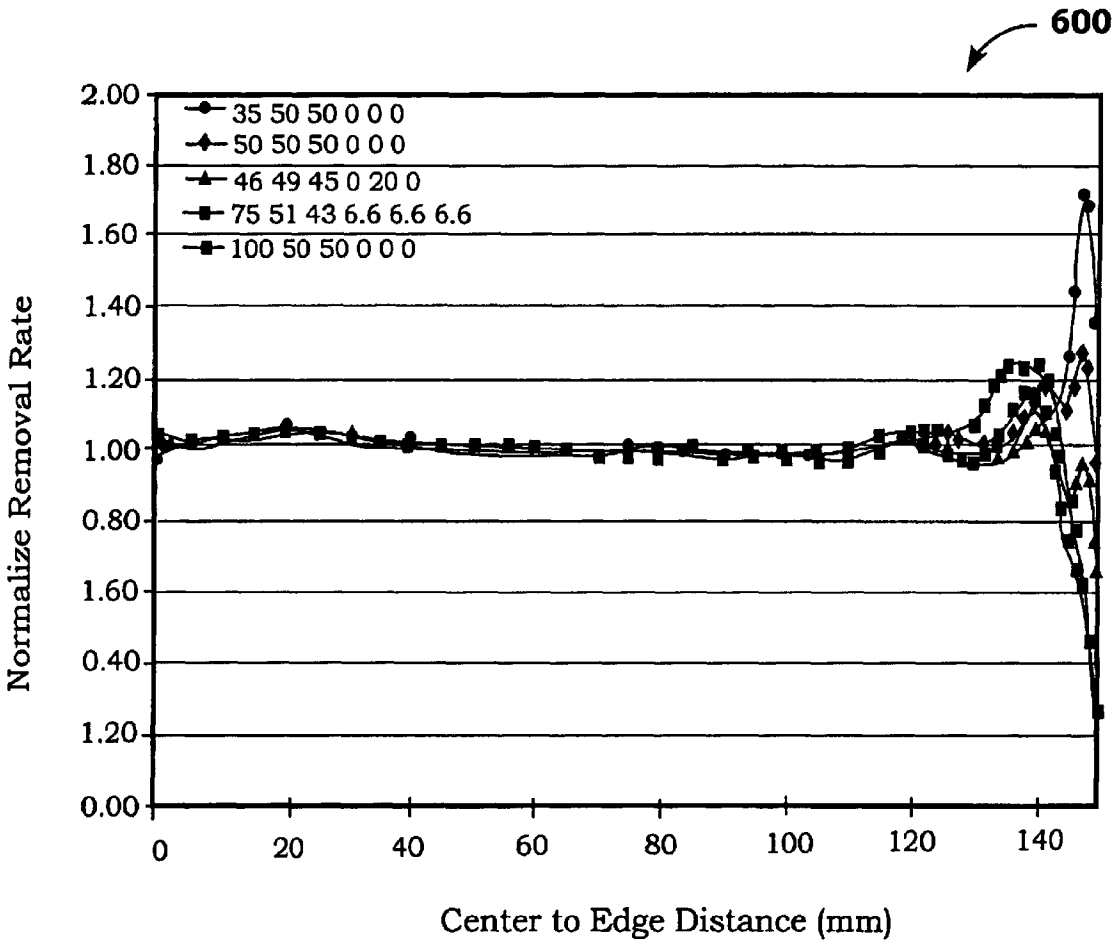
FIG. 6 is a graph illustrating the removal rate profile tunability that can be achieved using the embodiments of the present invention.

When using the embodiments of the present invention, the further inward an air zone is located, the greater affect that air zone has on the removal rate profile. Hence, by adjusting the pressure values for the different air pressure zones 500*a*–500*h*, the removal rate profiles can be altered. FIG. 6 is a graph 600 illustrating the removal rate profile tunability that can be achieved using the embodiments of the present invention. As illustrated in FIG. 6, a wide variety of removal rate profiles can be achieved by varying the air pressure provided by the air pressure zones when the belt tension is increased and a positive platen height is used. As can be appreciated, by combining optimal positive platen height with increased bell tension, and fine tuning the air pressure zones the edge effect can be greatly reduced.

Referring back to FIG. 5A, embodiments of the present invention primarily utilize air pressure zone 2 500*b*, air pressure zone 3 500*c*, and air pressure zone 4 500*c* to reduce edge effect during wafer planarization. Broadly speaking, air pressure zone 2 500*b* is primarily utilized to provide an air bearing for the polishing belt, while air pressure zone 3 500*c* and air pressure zone 4 500*d* are utilized to fine to the removal rate profile to reduce edge effect.

More specifically, in one embodiment, air pressure zone 2 500*b* provides air pressure in the range of about 30 psi–50 psi, and air pressure zone 3 500*c* and air pressure zone 4 500*d* each provide air pressure in the range of about 4 psi–13 psi. The remaining air pressure zones are set to provide zero air pressure. For example, in one embodiment the process parameters can be set as shown in Table 1 below.

TABLE 1

| Down Force | Belt Speed | Slurry flow | Zone 1 | Zone 2 | Zone 3 | Zone 4 | Zone 5 | Zone 6 | Zone 7 | Zone 8 |
|---|---|---|---|---|---|---|---|---|---|---|
| 4.5 psi | 300 fpm | 200 ml/min | 0 psi | 34 psi | 7 psi | 7 psi | 0 psi | 0 psi | 0 psi | 0 psi |

Because only three air zones are utilized, the fluid consumption for the platen manifold assembly 210 is greatly reduced. In addition, check values can be utilized to further reduce fluid consumption. Air pressure is provided to the air pressure zones 500*a*–500*h* using electronic regulators, which control the airflow to the air pressure zones 500*a*–500*h* to maintain a particular air pressure. However, the electronic regulators are not valves, and are not designed to prevent airflow into the platen.

Specifically, during wafer polishing, the platen manifold assembly 210 provides air pressure to the backside of the polishing belt. However, at the same time the carrier head provides a downforce to the polishing belt, which forces air back into the air holes of the air pressure zones that are not providing air pressure. This causes air to flow back to the air regulators, which simply exhaust the air in an attempt to maintain a zero air pressure flowing from the air pressure zone.

As a result, air pressure zones that are set to a zero air pressure conventionally allowed air to escape into the platen. To counteract the tendency for air to flow into the platen, prior art CMP methodologies provided air pressure from these air pressure zones equal to the downforce from the carrier head. In this manner, the positive airflow from the air pressure zone would cancel out the negative airflow from the carrier head downforce, thus resulting in a zero air pressure in that particular air pressure zone.

However, providing this additional airflow increases fluid consumption. Thus, embodiments of the present invention provide check values along the air supply system to block negative airflow. In this manner, the air pressure zones, such as air pressure zone 1 500*a*, air pressure zone 5 500*e*, air pressure zone 6 500*f*, air pressure zone 7 500*g*, and air pressure zone 8 500*h*, can be set to a zero air pressure without experiencing an airflow into the platen. As a result, embodiments of the present invention advantageously reduce fluid consumption by using only three air pressure zones to provide a positive airflow, and by using check values to prevent negative airflow. For example, conventional platen manifold assemblies often required about 90 standard cubic feet per minute (SCFM) of air during wafer planarization. Embodiments of the present invention can provide optimum wafer planarization with reduced edge effect using about 35 SCFM.

Figure 5B:
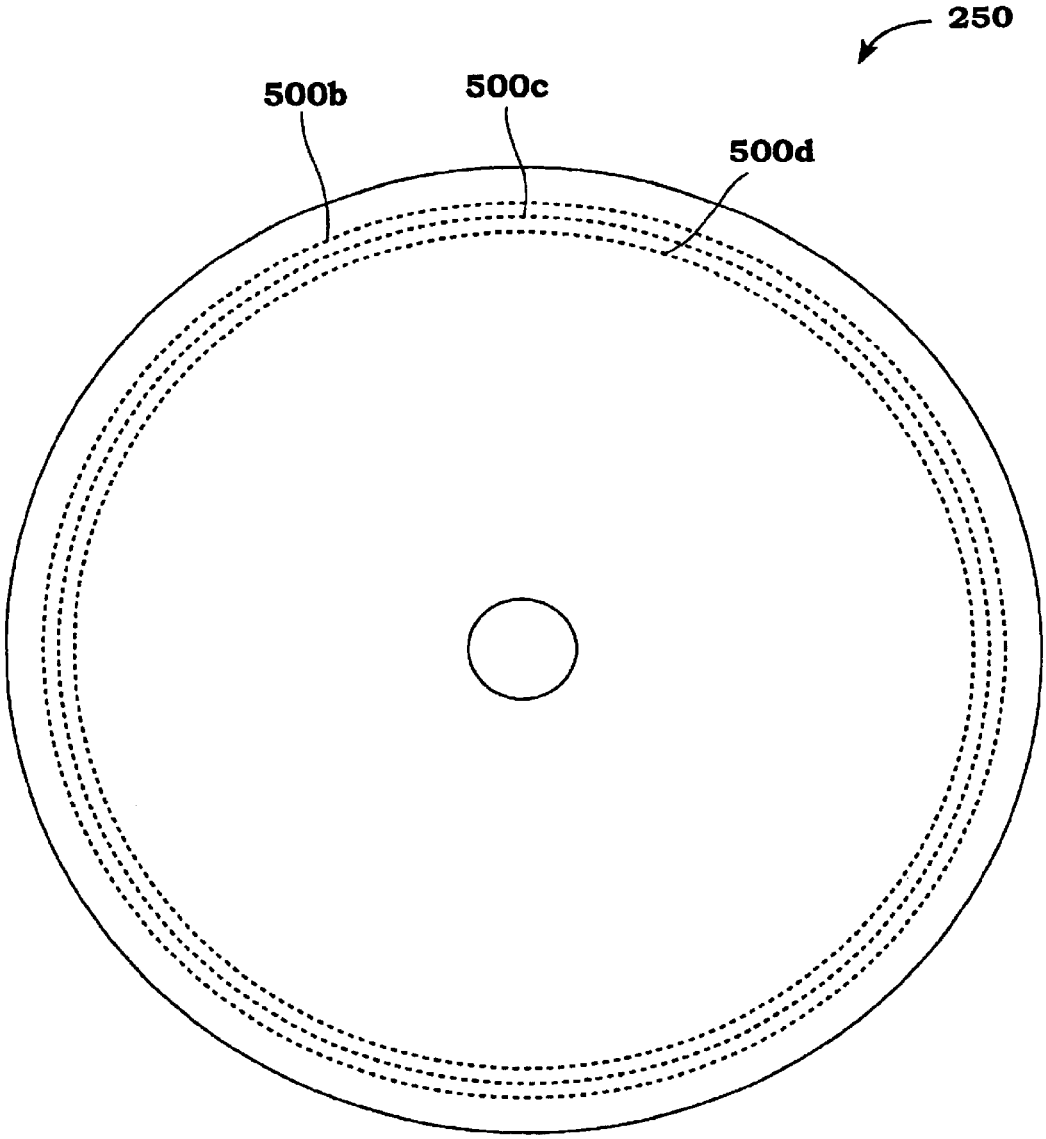
FIG. 5B is a top view of the platen manifold assembly having three air pressure zones, in accordance with an embodiment of the present invention.

In another embodiment of the present invention, the platen manifold assembly is modified to include only the air pressure zones having positive airflow. FIG. 5B is a top view of the platen manifold assembly 250 having three air pressure zones, in accordance with an embodiment of the present invention. The platen manifold assembly 250 includes a plurality of independently controlled air pressure zones 500*b*–500*d* utilized to provide air pressure to the back of the polishing belt during CMP operations. Each air pressure zone 500*b*–500*d* comprises a concentric ring of air holes, which are used to provide air to the backside of the polishing belt. As above, the air pressure provides an air bearing for the polishing belt to "ride" on during planarization. The air bearing also provides resistance to the downforce from the carrier head to allow polishing of the wafer surface.

Because all the air pressure zones 500*b*–500*d* in the air manifold assembly 250 provide a positive airflow, check valves and canceling positive airflows are not required. As shown in FIG. 5B, three air pressure zones are included in the platen manifold assembly 250, which are all located near the edge of the wafer during planarization.

As above, air pressure zone 2 500*b* is primarily utilized to provide an air bearing for the polishing belt, while air pressure zone 3 500*c* and air pressure zone 4 500*d* are utilized to fine tune the removal rate profile to reduce edge effect. Also as above, air pressure zone 2 500*b* provides air pressure in the range of about 30 psi–50 psi, and air pressure zone 3 500*c* and air pressure zone 4 500*d* each provide air pressure in the range of about 4 psi–13 psi. For example, in one embodiment the process parameters can be set as shown in Table 2 below.

TABLE 2

| Down Force | Belt Speed | Slurry flow | Zone 2 | Zone 3 | Zone 4 |
|---|---|---|---|---|---|
| 4.5 psi | 300 fpm | 200 ml/min | 34 psi | 7 psi | 7 psi |

Because only three air zones are utilized, the fluid consumption for the platen manifold assembly 250 is greatly reduced. In addition, as mentioned above, check valves and canceling positive airflows are not required when using the platen manifold assembly 250 because all the air pressure zones 500*b*–500*d* in the air manifold assembly 250 provide a positive airflow.

Figure 7:
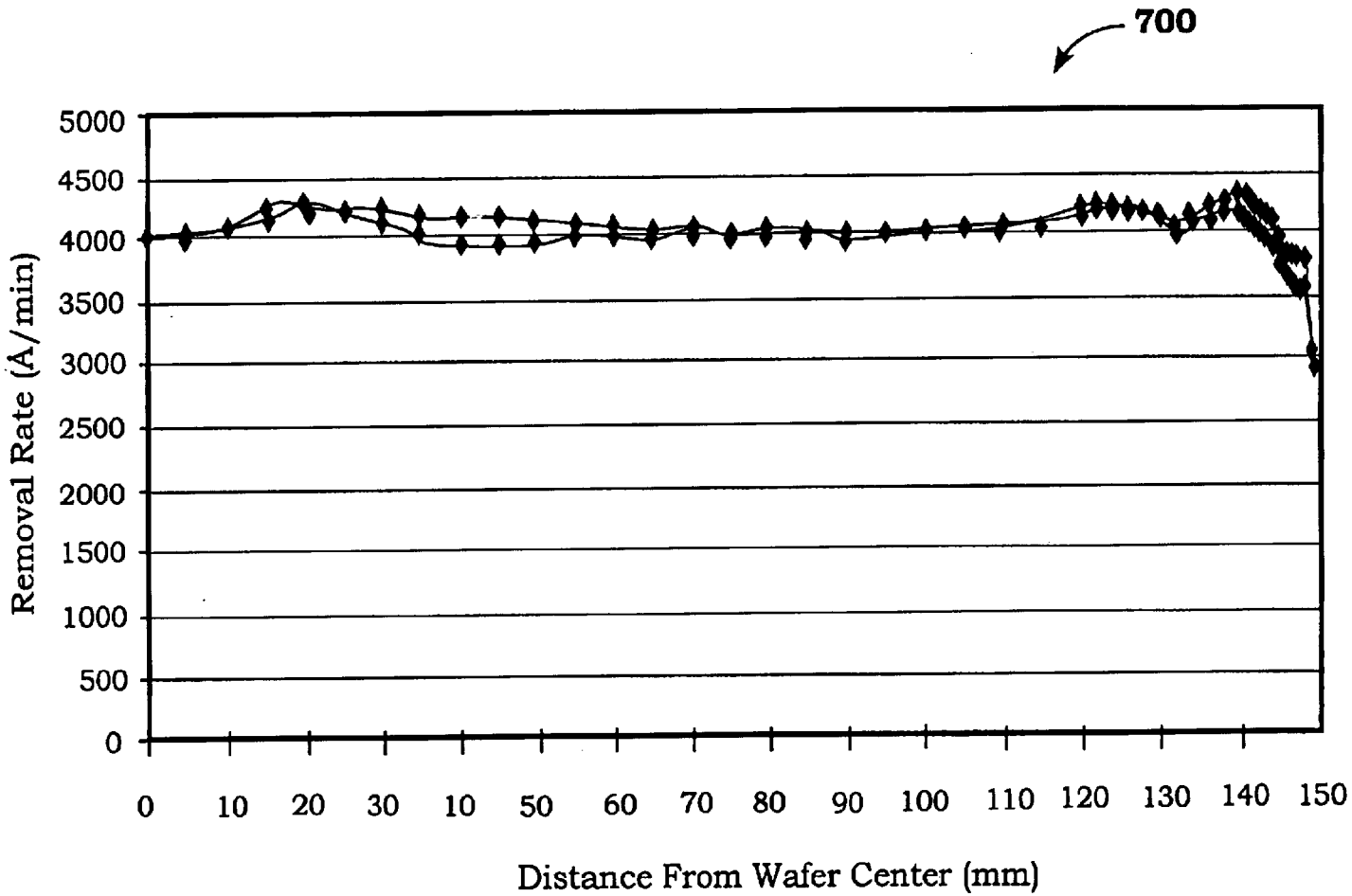
FIG. 7 is a graph showing a removal rate profile achieved using the embodiments of the present invention.

By utilizing the increased belt tension, positive platen height, and process parameters illustrated above in Table 1 and Table 2, embodiments of the present invention can greatly reduce or eliminate edge effect. FIG. 7 is a graph 700 showing a removal rate profiles achieved using the embodiments of the present invention. As can be seen in graph 700, the fast edge removal rate experienced by prior art CMP systems can be greatly reduced or eliminated using the embodiments of the present invention. As a result, wafer yield can be increased, while simultaneously reducing fabrication costs, through reduced fluid consumption and increased wafer yield.

Figure 8:
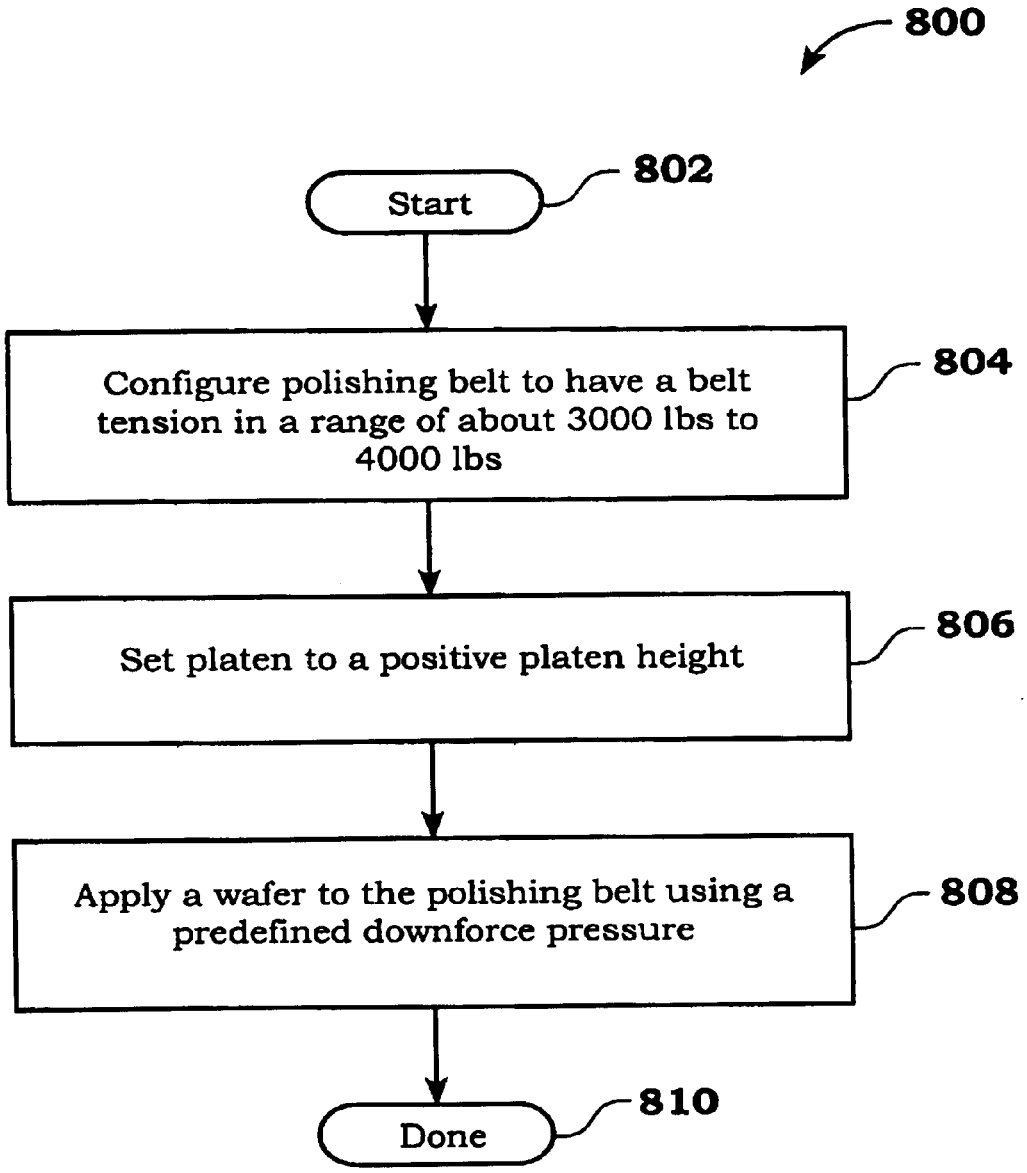
FIG. 8 is a flowchart showing a method for performing a CMP process having a reduced edge effect, in accordance with an embodiment of the present invention.

FIG. 8 is a flowchart showing a method 800 for performing a CMP process having a reduced edge effect, in accordance with an embodiment of the present invention. In an initial operation 802, preprocess operations are performed. Preprocess operations can include, for example, depositing material on the surface of the wafer, generating a mask on the surface of the wafer, etching a wafer layer, and other preprocess operations that will be apparent to those skilled in the art after a careful reading of the present disclosure.

In operation 804, the polishing belt is configured to have a belt tension in the range of about 3000 lbs to 4000 lbs. As mentioned above, embodiments of the present invention increase belt tension in the linear CMP apparatus to achieve optimal platen process performance. Belt tension is controlled using a pair of pistons, which exert force on one of the drums to manipulate the tension in the polishing belt. Embodiments of the present invention increase the force exerted on the drums to a force in the range of about 3000 lbs to about 4000 lbs, using the pair of pistons. As a result, the belt tension for the CMP apparatus is dramatically increased.

As noted previously, it should be understood that embodiments of the present invention are not limited to the use of pistons to exert force on the drums. That is, any source of force can be utilized to exert force on the drums and thus control belt tension, such as lever and pulley based force sources, chain based force sources, and other sources of force that will be apparent to those skilled in the art after a careful reading of the present disclosure. The increased belt tension allows the removal rate profile to be greatly affected, and thus optimally tuned, using platen height and air zone pressures.

The platen is set to a positive platen height, in operation 806. As discussed previously, platen height refers to the position of the top surface of the platen manifold assembly with respect to the top of the drums. A positive platen height occurs when the top surface of the platen manifold assembly is above the drum height. Conversely, a negative platen height occurs when the top surface of the platen manifold assembly is below the drum height. A platen height of zero occurs when the top surface of the platen manifold assembly coincides with the drum height.

Embodiments of the present invention utilize a positive platen height, in conjunction with the increased bell tension, to reduce edge effect during wafer planarization. In one embodiment, the platen height is in the range of about 25 mil to 65 mil. For example, the platen height can be about 48 mil. In this manner, the positive platen causes a mechanical deformation of the polishing belt, which allows the air pressure zones of the platen manifold assembly to greatly affect the planarization process.

In operation 808, the wafer is applied to the polishing belt using a predefined downforce pressure. To provide an air bearing for downforce pressure resistance, and to provide a surface for the polishing belt to "ride" on, embodiments of the present invention utilize the $2^{nd}$, $3^{rd}$, and $4^{th}$ air pressure zones on the platen manifold assembly. As noted above, air pressure zone 2 is primarily utilized to provide an air bearing for the polishing belt, while air pressure zone 3 and air pressure zone 4 are utilized to fine to the removal rate profile to reduce edge effect. More specifically, in one embodiment, air pressure zone 2 provides air pressure in the range of about 30 psi–50 psi, and air pressure zone 3 and air pressure zone 4 each provide air pressure in the range of about 4 psi–13 psi. The remaining air pressure zones are set to provide zero air pressure.

Post process operations are performed in operation 810. Post process operations can include, for example, wafer cleaning, further wafer masking and etching, and other post process operations that will be apparent to those skilled in the art after a careful reading of the present disclosure. Using the above method, wafer edge effect can be greatly reduced. Further, embodiments of the present invention reduce advantageously reduce fluid consumption by utilizing only three air pressure zones during wafer planarization. Thus, the embodiments of the present invention improve within wafer nonuniformity.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A chemical mechanical planarization (CMP) apparatus for processing wafers, comprising:

a polishing belt having a belt tension capable of reducing edge effect during wafer planarization;

a belt tension control device configured to manage the belt tension; and a platen disposed below the polishing belt at a positive platen height, the platen having at least three air pressure zones, each air pressure zone capable of providing air pressure to a backside of the polishing belt, wherein a first outermost air pressure zone primarily provides an air bearing, and wherein a second and third air pressure zone primarily control tuning of the removal rate profile.

2. A CMP apparatus as recited in claim 1, wherein the belt tension is in a range of about 3000 lbs to 4000 lbs.

3. A CMP apparatus as recited in claim 1, wherein the platen is positioned at a platen height in a range of about 25 mil–65 mil.

4. A CMP apparatus as recited in claim 3, wherein the platen height is about 48 mil.

5. A CMP apparatus as recited in claim 1, wherein the platen includes eight air pressure zones.

6. A CMP apparatus as recited in claim 5, wherein a second air pressure zone adjacent to a first outermost air pressure zone provides an air pressure in a range of about 30 psi to 50 psi.

7. A CMP apparatus as recited in claim 6, wherein the second air pressure zone provides an air pressure of 34 psi.

8. A CMP apparatus as recited in claim 6, wherein a third air pressure zone adjacent to the second air pressure zone and a fourth pressure zone adjacent to the third air pressure zone each provide an air pressure in a range of about 4 psi to 13 psi.

9. A CMP apparatus as recited in claim 8, wherein the third air pressure zone and the forth air pressure zone each provide an air pressure of 7 psi.

10. A CMP apparatus as recited in claim 8, wherein the first air pressure zone, a fifth air pressure zone, a sixth air pressure zone, a seventh air pressure zone, and an eighth air pressure zone all provide an air pressure of 0 psi.

11. A CMP apparatus as recited in claim 10, further comprising a plurality of check valves disposed within an air supply system coupled to the platen, wherein the check valves prevent negative airflow into the platen.

12. A chemical mechanical planarization (CMP) apparatus for processing 300 millimeter wafers, comprising:

a polishing belt having a belt tension in a range of about 3000 lbs to 4000 lbs; and a platen disposed below the polishing belt at a positive platen height, the platen having three independently controlled air pressure zones, each air pressure zone capable of providing air pressure to a backside of the polishing belt, wherein a first outermost air pressure zone primarily provides an air bearing, and wherein a second and third air pressure zone primarily control tuning of a removal rate profile.

13. A CMP apparatus as recited in claim 12, wherein the platen is positioned at a platen height in a range of about 25 mil–65 mil.

14. A CMP apparatus as recited in claim 13, wherein the first air pressure zone provides an air pressure in a range of about 30 psi to 50 psi, and wherein the second air pressure zone and the third air pressure zone each provide an air pressure in a range of about 4 psi to 13 psi.

15. A CMP apparatus as recited in claim 14, wherein the first air pressure zone provides an air pressure of 34 psi, and wherein the second air pressure zone and the third air pressure zone each provide an air pressure of 7 psi.

* * * * *